US007204296B2

(12) United States Patent
Redemske et al.

(10) Patent No.: US 7,204,296 B2
(45) Date of Patent: Apr. 17, 2007

(54) METHOD OF REMOVING A FUGITIVE PATTERN FROM A MOLD

(75) Inventors: John A. Redemske, Milford, NH (US); Richard Ullrich, Brookline, NH (US)

(73) Assignee: Metal Casting Technology, Incorporated, Milford, NH (US)

( * ) Notice: Subject to any disclaimer, the term of this patent is extended or adjusted under 35 U.S.C. 154(b) by 395 days.

(21) Appl. No.: 10/899,381

(22) Filed: Jul. 26, 2004

(65) Prior Publication Data

US 2006/0017186 A1 Jan. 26, 2006

(51) Int. Cl.
*B22C 9/04* (2006.01)

(52) U.S. Cl. ..... 164/516; 164/35; 164/44

(58) Field of Classification Search ..... 164/34–36, 164/516–519, 44

See application file for complete search history.

(56) References Cited

U.S. PATENT DOCUMENTS

| | | | | |
|---|---|---|---|---|
| 3,336,970 | A | 8/1967 | Watts et al. | 164/62 |
| 3,770,044 | A | 11/1973 | Heath | 164/35 |
| 3,894,572 | A | 7/1975 | Narayan et al. | 260/2.5 AW |
| 4,240,493 | A | 12/1980 | Wilmarth | 164/35 |
| 4,754,798 | A | 7/1988 | Chandley et al. | 164/35 |
| 4,925,492 | A | 5/1990 | Kelkar et al. | 106/38.35 |
| 4,940,072 | A * | 7/1990 | Pellman et al. | 164/35 |
| 4,961,459 | A | 10/1990 | Blazek | 164/122.1 |
| 5,063,992 | A | 11/1991 | Mrdjenovich et al. | 164/516 |
| 5,069,265 | A | 12/1991 | Blazek | 164/35 |
| 5,069,271 | A | 12/1991 | Chandley et al. | 164/516 |
| 5,076,345 | A | 12/1991 | Tausk | 164/516 |
| 5,203,398 | A | 4/1993 | Easwaran | 164/516 |
| 5,296,308 | A | 3/1994 | Caccavale et al. | 428/586 |
| 5,327,955 | A | 7/1994 | Easwaran | 164/516 |
| 5,465,780 | A | 11/1995 | Muntner et al. | 164/516 |
| 5,468,170 | A | 11/1995 | Kantor et al. | 446/23 |
| 5,909,765 | A | 6/1999 | McDowell | 164/516 |
| 6,032,719 | A | 3/2000 | Baum | 164/35 |
| 6,123,141 | A | 9/2000 | Baum | 164/35 |
| 6,352,101 | B1 | 3/2002 | Ghosh et al. | 164/516 |
| 6,431,255 | B1 | 8/2002 | Ghosh et al. | 164/361 |
| 6,446,697 | B1 | 9/2002 | Shaikh et al. | 164/4.1 |

FOREIGN PATENT DOCUMENTS

| | | |
|---|---|---|
| GB | 2126148 | 3/1984 |
| JP | 63194842 A2 | 8/1988 |
| JP | 04052045 A | 2/1992 |
| JP | 6285584 | 10/1994 |

* cited by examiner

*Primary Examiner*—Kuang Y. Lin

(57) ABSTRACT

A method is provided for removing a fugitive pattern, such as wax or other meltable pattern material, residing inside of a refractory mold by discharging condensable vapor such as steam inside the mold to contact and melt the pattern while an exterior of the mold is subjected to a non-condensing gas atmosphere such as air outside of the mold wherein the condensable vapor inside the mold and the atmosphere outside of the mold are at substantially the same pressure. Condensable vapor is condensed inside the mold where the vapor has contacted the pattern while the exterior of the mold remains free of condenate. The condensed vapor and melted pattern material are drained out of the mold. The condensed vapor can be discharged initially inside a hollow sprue of a fugitive pattern assembly to melt the sprue and then inside the mold to melt the patterns of the pattern assembly. The method allows the removal of fugitive pattern materials from molds of any thickness and reduces the cracking of the mold during pattern removal.

37 Claims, 7 Drawing Sheets

METHOD OF REMOVING A FUGITIVE PATTERN FROM A MOLD

FIELD OF THE INVENTION

This invention relates to method and apparatus for removing a fugitive pattern from a metal casting mold.

BACKGROUND OF THE INVENTION

The well-known "lost wax" investment casting process typically uses a refractory mold that is constructed by the buildup of successive layers of ceramic particles bonded with an inorganic binder on a fugitive (expendable) pattern material such as typically a wax, plastic and the like. The finished refractory mold is usually formed as a shell mold around a fugitive pattern.

The refractory shell mold residing on the fugitive pattern typically is subjected to a pattern removal operation, wherein the pattern is melted out of the shell mold. This operation leaves an empty "green" (unfired) refractory shell mold. The fugitive pattern materials typically have a thermal expansion rate many times greater than that of the refractory shell mold. If the fugitive pattern and refractory mold are heated uniformly, the fugitive pattern material will thermally expand more than the refractory mold. This will place the refractory shell mold under tension and will ultimately crack the shell mold. The avoidance of such shell mold cracking is why the fugitive pattern material removal has been typically conducted by methods such as a high pressure steam autoclaving or flash firing pattern removal. The removal of the fugitive pattern material by a high pressure steam autoclaving or flash firing is done to expose the outside of the refractory shell mold to high temperature. This high temperature causes heat to be conducted through the refractory shell mold more quickly so as to melt the surface of the pattern before the interior of the pattern thermally expands. This surface layer of melted pattern material extends all the way to where the pattern is exposed at the open part of the mold and accommodates the expanding pattern material inside the mold by forcing some of the liquid surface pattern material out of the mold opening. Such methods can still allow cracking of the refractory shell mold if the heat is not applied in a continuum along the surface of the fugitive pattern inside the mold. The connecting together of the refractory shell mold between adjacent patterns is one of the major causes of non-uniform heating of the pattern. That is, thicker regions of the refractory shell mold will hinder the application of heat to the pattern material and locally delay the melting of the surface of the pattern and disrupting of the continuum. This prevents the passage of surface liquid pattern material from a thinner mold region more remote from the mold opening than the thicker mold region. Such prevention of the passage of surface liquid pattern material causes a buildup of pattern pressure in the remote thinner mold region due to the thermal expansion of the pattern material and can lead to mold cracking. These problems require the use of a mold strong enough (e.g. thick enough) to resist the expansion pressure of the pattern material and often require the use of supplemental holes or vents through the mold to relieve pressure from unconnected expanding patterns. Stronger or thicker molds as well as the venting method are undesirable as they increase processing costs.

A plurality of the green refractory shell molds (sans patterns) then typically are loaded into a batch or continuous oven heated by combustion of gas or oil and heated to a temperature of 1600° F. to 2000° F. Alternatively, the mold may be heated by a method of copending patent application Ser. No. 10/241,819 filed Sep. 10, 2002, of common assignee herewith, which describes the heating of a mold with or without surrounded mold support sand. The heated refractory molds are removed from the oven and molten metal or alloy is cast into them.

The trend in investment casting is to make the refractory shell mold as thin as possible to reduce the cost of the mold as described above. The use of thin shell molds has required the use of support media to prevent mold failure as described by Chandley et. al. U.S. Pat. No. 5,069,271. The '271 patent discloses the use of bonded ceramic shell molds made as thin as possible such as less than 0.12 inch in thickness. Unbonded support particulate media is compacted around the thin hot refractory shell mold after it is removed from the preheating oven. The unbonded support media acts to resist the stresses applied to the shell mold during casting so as to prevent mold failure.

Thin shell molds however, are more prone to cracking during the pattern removal operation, such as the high pressure steam autoclave or flash fire pattern removal operation mentioned above, wherein the pattern is melted out of the shell mold.

The present invention provides a method of removing a fugitive pattern from a bonded refractory mold in a manner that reduces cracking of the mold.

SUMMARY OF THE INVENTION

An embodiment of the present invention provides a method of removing a fugitive pattern, such as wax or other meltable pattern material, residing in a refractory mold by discharging condensable vapor, such as steam, inside the mold to contact and melt the pattern while the exterior of the mold is subjected to a non-condensing gas atmosphere, such as ambient air, outside of the mold. The condensed vapor and melted pattern material are drained out of the mold.

A pressure differential between the condensable vapor inside of the mold and the non-condensing gas atmosphere outside of the mold is small enough as to prevent the condensable gas from exiting outside the mold exterior and the non-condensing gas from entering the mold cavity. The condensable vapor inside of the mold and the gas atmosphere outside of the mold preferably are at substantially the same pressure to this end. In this way, when steam is used as the preferred condensable vapor, the steam is condensed inside the mold where the steam has contacted the pattern while the exterior of the mold remains dry. The condensable vapor can be discharged inside the mold at atmospheric, subatmospheric, or superatmospheric pressure depending upon the melting point of the pattern material.

In a preferred embodiment of the present invention, steam or other condensable vapor is discharged initially inside a hollow sprue of a pattern assembly to melt the sprue and then to proceed to melt the patterns of the pattern assembly. The hollow sprue can be preformed or, alternatively, can be formed in-situ in a solid precursor sprue of the pattern assembly while it resides in the mold by relative movement of a steam discharge tube and the solid precursor sprue.

In another preferred embodiment of the invention, a method is provided for removing a fugitive pattern from a refractory mold residing in a particulate media. The method involves discharging steam or other condensable vapor inside the mold to contact and melt the pattern while an exterior of the mold contacts the particulate media and is subjected to a non-condensing gas (e.g. steam-free) atmosphere, condensing vapor inside the mold where it contacts the pattern while the exterior of the mold and the particulate media therearound are subjected to a non-condensing gas atmosphere, and draining the melted pattern material and condensed vapor out of the mold.

In an apparatus embodiment of the invention, steam or other condensable vapor is supplied from a source to a discharge tube that is positionable inside the mold and/or pattern sprue to discharge steam or condensable vapor at substantially atmospheric, subatmospheric or superatmospheric pressure therein.

The invention is advantageous to remove one or more fugitive patterns residing in a metal casting refractory mold, which may have any mold wall thickness and which may be unsupported or supported by exterior particulate media therearound. The invention is further advantageous to remove one or more fugitive patterns while avoiding saturating the mold wall with steam or other condensate, which may have adverse effects on the binder used to fabricate the mold. The invention may be practiced to reduce mold cracking during pattern removal and to remove pattern material from molds where steam cannot readily access the exterior of the mold wall such as when the mold is supported with particulate support media.

These and other advantages of the invention will become apparent from the following detailed description taken with the following drawings.

DESCRIPTION OF THE INVENTION

The present invention involves a method of removing one or more fugitive patterns residing inside of a refractory mold. The method is especially useful to remove one or more fugitive patterns from inside a gas permeable "lost wax" investment casting ceramic shell mold, although the invention is not so limited as it can be practiced to remove one or more fugitive patterns from other types of refractory metal casting molds which have one or more fugitive patterns therein, which may have any mold wall thickness, and which may be unsupported or supported by exterior particulate media therearound. When steam is used as a preferred condensable vapor, the invention can be practiced to remove one or more fugitive patterns that may comprise conventional wax patterns or other pattern materials that are melted at a temperature below the boiling point of water (e.g. about 212 degrees F.) under the particular ambient atmospheric pressure conditions present during the pattern removal operation.

Another embodiment of the invention also can be practiced to remove one or more fugitive patterns that may comprise conventional wax patterns or other pattern materials that are melted at a temperature above the boiling point of water by using superatmospheric steam to this end during the pattern removal operation pursuant to another embodiment of the invention described below. Still another embodiment of the invention can be practiced using subatmospheric pressure steam to remove one or more fugitive patterns that may require lower temperatures to melt them.

Alternatively in practicing the invention, the steam can be replaced by a condensable vapor of another suitable material, such as for purposes of illustration and not limitation mineral spirits having a boiling point of about 300 degrees F., wherein the vapor can be condensed and give up heat to the fugitive pattern when it makes contact with the pattern for pattern melting purposes.

Figure 1:
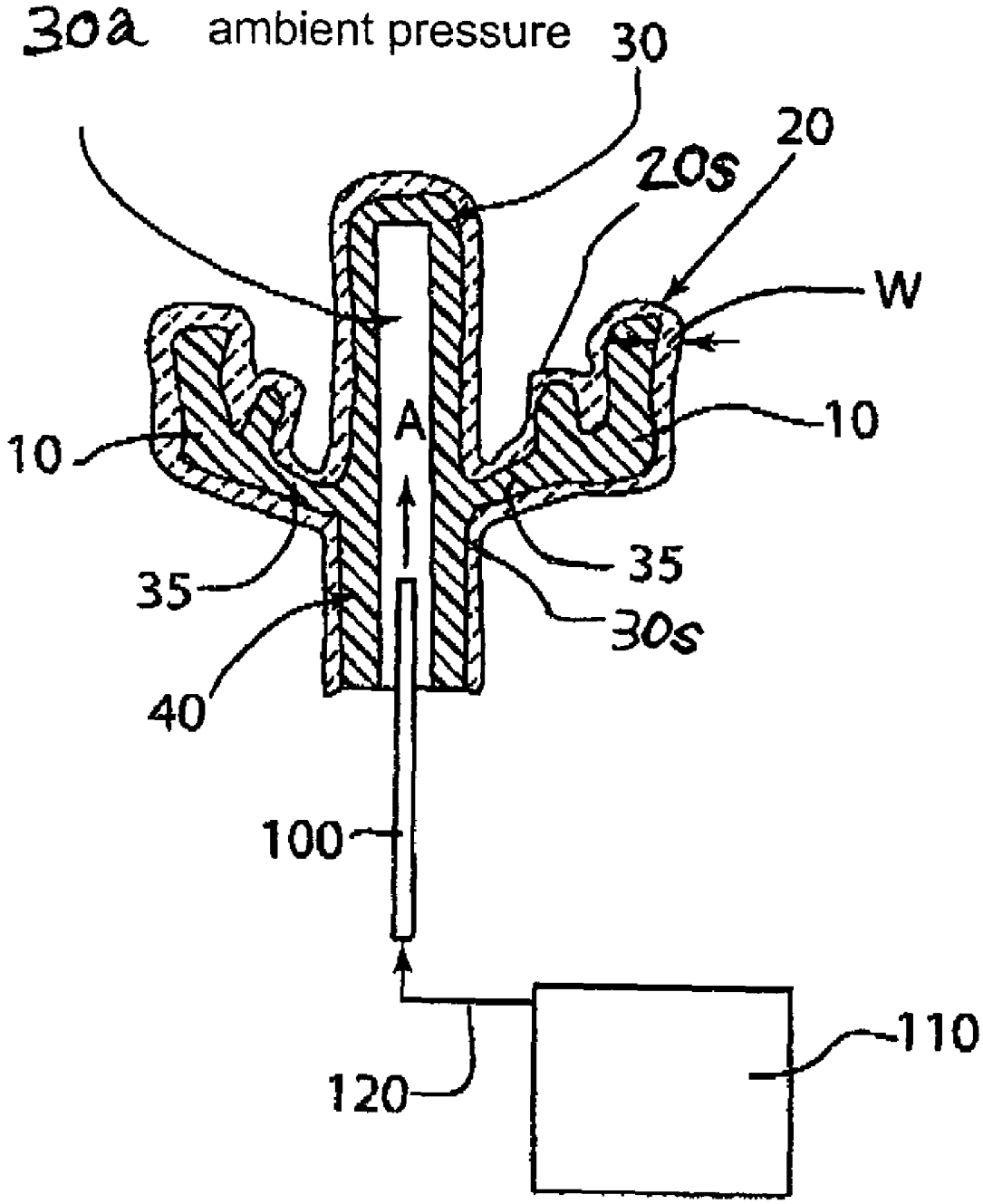
FIG. 1 is a schematic view of a refractory investment casting shell mold having fugitive patterns to be removed pursuant to an embodiment of the invention by discharging atmospheric pressure steam from a steam discharge tube shown positioned inside a hollow sprue of a pattern assembly residing inside the mold.

For purposes of illustration and not limitation, a method embodiment of the present invention will be described below in connection with FIGS. 1–4 with respect to removing a plurality of wax patterns 10 attached by respective gate 35 to a central hollow sprue 30 of a pattern assembly 40 from inside of a "lost wax" investment casting shell mold 20. In FIG. 1, the hollow sprue 30 comprises a preformed wax sprue having axially elongated interior chamber 30*a* and having the patterns 10 attached by wax welding or fastening technique to its exterior surface 30*s*. For purposes of illustration and not limitation, the wax sprue 30 can be preformed to have the interior chamber 30*a* by molding, extrusion, by initially forming the sprue on a cylindrical or other shape mandrel which is subsequently removed by heating the mandrel and thus adjacent wax to allow mandrel to be physically withdrawn, by drilling a solid wax sprue, or by any other suitable technique.

Although two patterns 10 are shown in FIG. 1, those skilled in the art will appreciate that additional patterns 10 typically are attached about the sprue 30 at the same location as patterns 10 but are out of view in FIG. 1 as a result of its being a sectional view. Moreover, additional patterns 10 can be attached by gates about the sprue 30 at other axial locations along its length (e.g. above the patterns 10 shown in FIG. 1) as is well known and shown for example in U.S. Pat. No. 5,069,271, the teachings of which are incorporated herein by reference.

Figure 6:
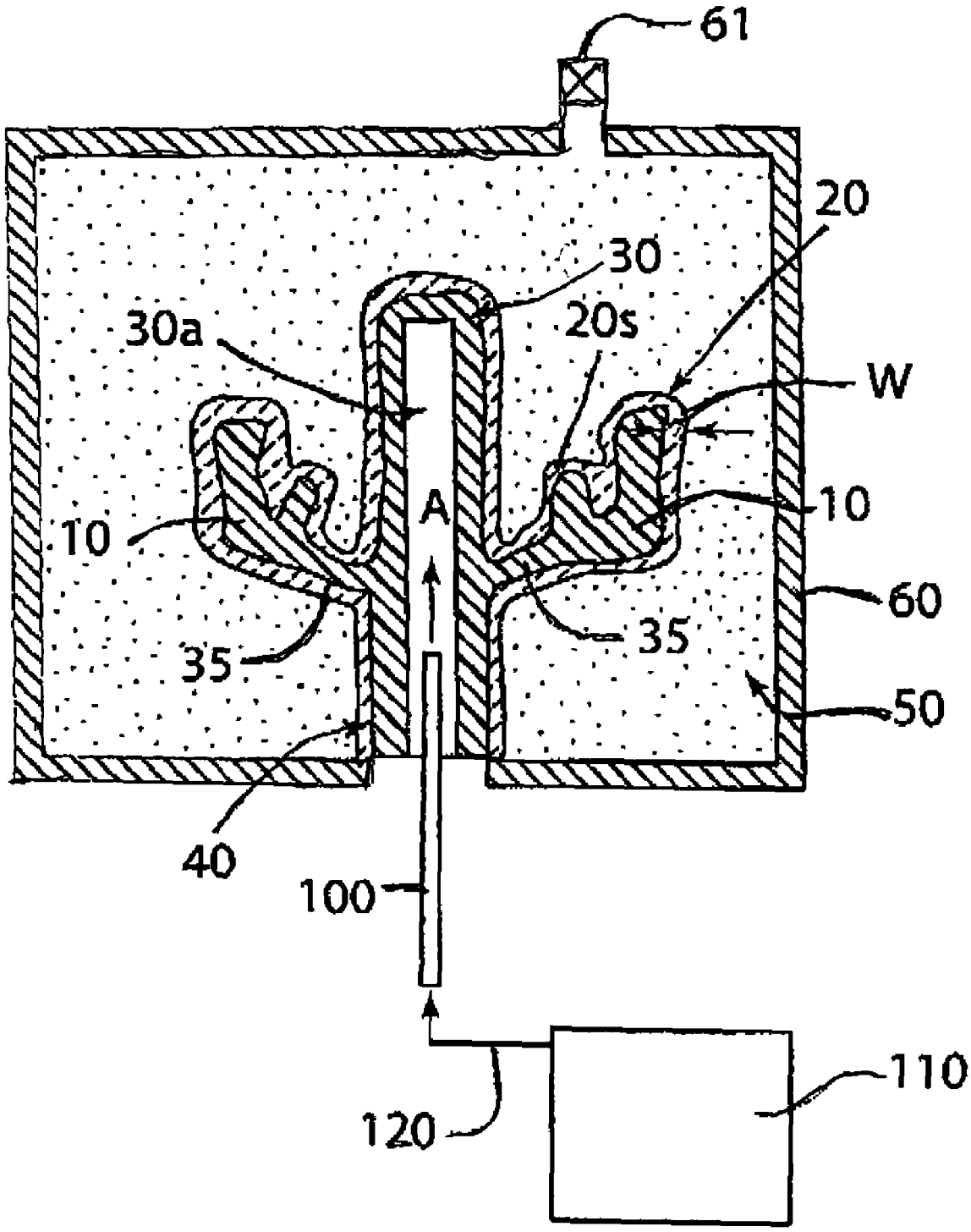
FIG. 6 is a schematic view of a refractory investment casting shell mold having fugitive patterns to be removed pursuant to an embodiment of the invention wherein the mold is exteriorly supported by a particulate support media therearound.

Referring to FIG. 1, a "lost wax" investment casting shell mold 20 is shown invested on a plurality of wax patterns 10 attached by gates 35 about a central wax sprue 30 by the conventional "lost wax" process for making shell molds as described, for example, in U.S. Pat. No. 5,069,271, wherein the pattern assembly 40 including the patterns 10 attached by gates 35 to hollow sprue 30 is repeatedly dipped in a refractory slurry having a binder, stuccoed with coarse refractory stucco particles, and dried to build up the shell mold on the pattern assembly. The patent describes a gas permeable thin wall shell mold having a mold wall thickness of about ⅛ inch or less. Such a thin wall mold 20 as described in the patent can be supported in a casting container 60 by a particulate support media 50 (e.g. ceramic particulates) as shown in FIG. 6 during the pattern removal operation. The invention is not limited to practice with such a thin wall shell mold supported by a particulate media therearound and, instead, can be practiced with a refractory mold of any mold wall thickness, whether exteriorly supported by particulate support media or whether unsupported as shown in FIG. 1.

The shell mold 20 is shown inverted (i.e. oriented upside down) to allow the melted pattern material and condensed steam to drain by gravity from the lower end of the sprue 30. The mold 20 can be positioned in other orientations that facilitate drainage of the melted pattern material and condensed steam out of the mold. Moreover, the mold 20 may be moved during the pattern removal operation in a manner that facilitates drainage of the melted pattern material and condensed steam out of the mold.

Referring to FIG. 1, a steam discharge tube 100 is shown positioned in the elongated chamber 30*a* of the hollow sprue 30 of the pattern assembly 40 to discharge a stream (represented by the arrow "A") of steam at substantially atmospheric pressure inside the hollow sprue 30 of the pattern assembly 40 to contact and melt the wax pattern assembly while the exterior surface 20*s* of the mold 20 is subjected to substantially ambient atmospheric air pressure (represented by "ambient pressure"). The ambient air forming a non-condensing gas atmosphere about the mold 20 in FIG. 1 can be at ambient temperature or can be refrigerated relative to ambient temperature. A typical wax material from which the pattern assembly 40 is made melts and becomes quite fluid at about 180 degrees F. for purpose of illustration and not limitation. The steam at substantially atmospheric pressure is generated in a steam source 110, which may comprise a conventional steam generator commercially available as Model LB240 from The Electro Steam Generator Corp. The steam flows from the steam generator or source 110 through a supply tube 120 to the steam discharge tube 100. Flow of the steam from the source or generator 110 can be assisted by adjusting the pressure in the steam generator so that adequate steam will flow through the pipe into the mold to replace the amount of steam that has condensed.

The steam at substantially atmospheric pressure discharged in the chamber 30*a* at a sufficiently high flow rate to displace air from the chamber 30*a* and progressively contacts and melts the pattern material of the wax sprue 30 and then the gates 35 and patterns 10. The flow rate of the steam discharged into the chamber 30*a* may be varied during removal of the sprue and patterns depending upon the rate of condensation of the steam inside the mold. This rate will be dependant upon the surface area of the wax exposed to the steam at that point during de-waxing, and the size of the mold. When multiple rows of patterns and gates are attached to the sprue along its length, the steam progressively melts the pattern material of each pattern uniformly from the gate and sequentially proceeding into the pattern.

In practice of the invention, the wax sprue 30 may not be present or may be removed by other means prior to removal of the patterns 10 by contact with the steam. That is, if only patterns 10 are present in shell mold 20 having an empty central sprue type passage, then the steam discharge tube 100 is positioned to discharge the steam inside the mold 20 to contact and melt only patterns 10 and any gates 35 associated therewith.

Figure 2:
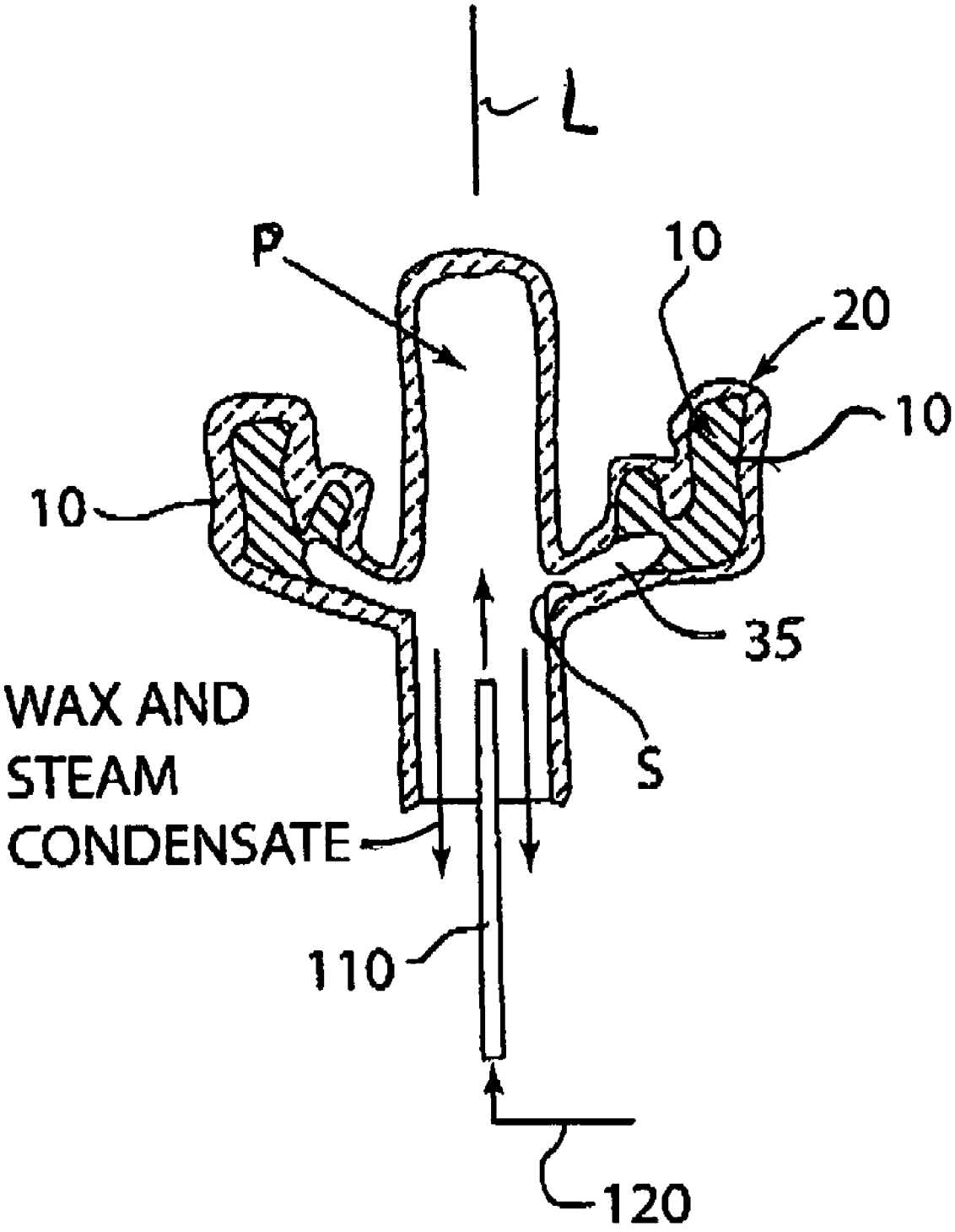
FIG. 2 is a schematic view of the refractory investment casting shell mold of FIG. 1 with the hollow sprue of the fugitive pattern assembly already removed by melting and with the individual gates and patterns being melted and removed.
Figure 4:
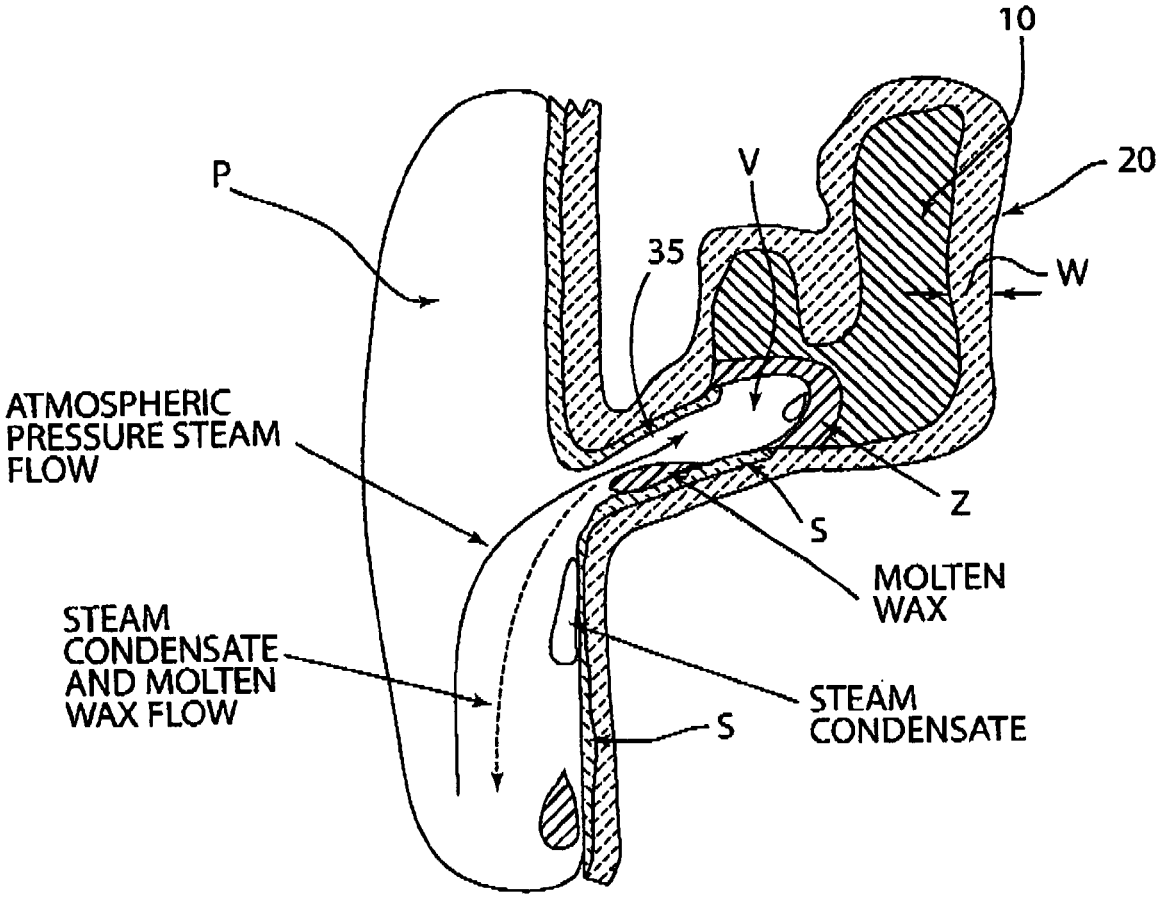
FIG. 4 is an enlarged view of an individual pattern of FIG. 2 illustrating removal of the pattern.

FIGS. 2 and 4 illustrate the pattern removal process after the central hollow sprue 30 has been melted and removed and while a gate 35 and pattern 10 are being melted and removed. The steam is shown being drawn toward the gate 35 and associated pattern 10 as the steam condenses where the steam has melted the wax pattern material. In particular, as the steam condenses at the surface of the gate and pattern, a relative lower pressure is generated at region V proximate where the gate and/or pattern material is melted to cause fresh downstream steam to flow toward the region of the gate and pattern that has melted. The liquid wax material that has melted soaks partially into the inner mold wall surface as illustrated at surface region S and acts as a barrier to prevent steam condensate from soaking through the thickness of the mold wall W. Moreover, the presence of atmospheric air pressure on the exterior surface 20*s* of the mold 20 provides no driving force to cause the steam condensate to pass through the mold wall, thereby avoiding saturation of the mold wall with steam condensate and the adverse effects on the binder present in the mold wall. During the pattern removal operation, the exterior surface 20*s* of the mold exposed to ambient air (as a non-condensing gas atmosphere) remains dry (devoid of liquid water) as a result.

A pressure differential between the condensable vapor inside of the mold 20 and the non-condensing gas atmosphere outside of the mold 20 is small enough as to prevent the condensable gas from exiting outside the mold exterior through the gas permeable mold wall W and the non-condensing gas from entering via wall W the mold cavity occupied by the fugitive pattern assembly being removed. The condensable vapor inside the mold and the non-condensing gas atmosphere outside of the mold preferably are at substantially the same pressure to this end.

As illustrated in FIG. 4, the steam condensate and the melted wax pattern material are drained out of the mold 20 by gravity through the sprue void or passage P created when the hollow wax sprue 30 has been removed. The melted wax pattern material may be collected on or in a collection tray or container (not shown) positioned below the mold 20 in FIG. 1. An axis of the mold 20, such as longitudinal axis L of the mold 20, containing the fugitive pattern can be tilted with respect to the direction of gravity during the melting of the fugitive pattern or after the fugitive pattern has been melted.

The steam at substantially atmospheric pressure is believed to produce only a small heat affected zone Z in the wax pattern such that the remaining unmelted portion of the solid wax pattern 10 is relatively unaffected by the steam, although Applicants do not wish to be bound by any theory in this regard. This small area of heated but not melted pattern material is free to thermally expand toward the melted surface, therefore resulting in little or no stress on the surrounding refractory mold. The thermal expansion of the wax inside the mold is the cause of the mold cracking during standard autoclave de-waxing.

Figure 3:
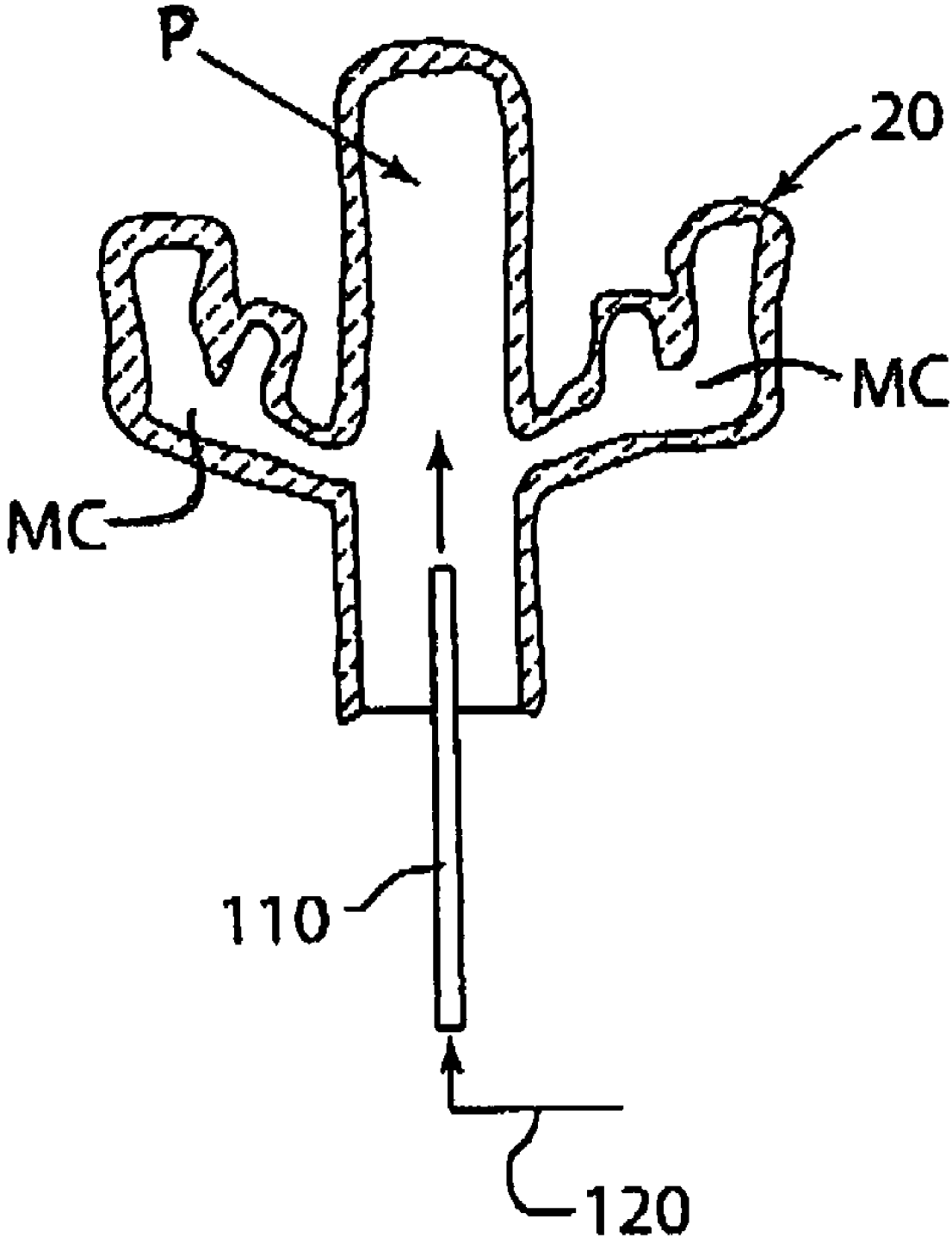
FIG. 3 is similar to FIG. 2 after the patterns have been completely removed from the shell mold.

The discharge of steam from the steam discharge tube 100 inside the mold is continued until the entire pattern assembly 40 (including the hollow sprue 30 and patterns 10) is melted and removed from the mold 20, leaving an empty shell mold 20 that includes a plurality of mold cavities MC connected to the sprue passage P as shown in FIG. 3. The mold then is ready to be fired at a suitable firing temperature to prepare the mold for receiving molten metal or alloy to be cast in the mold as is well known and forming no part of the invention.

Figure 5:
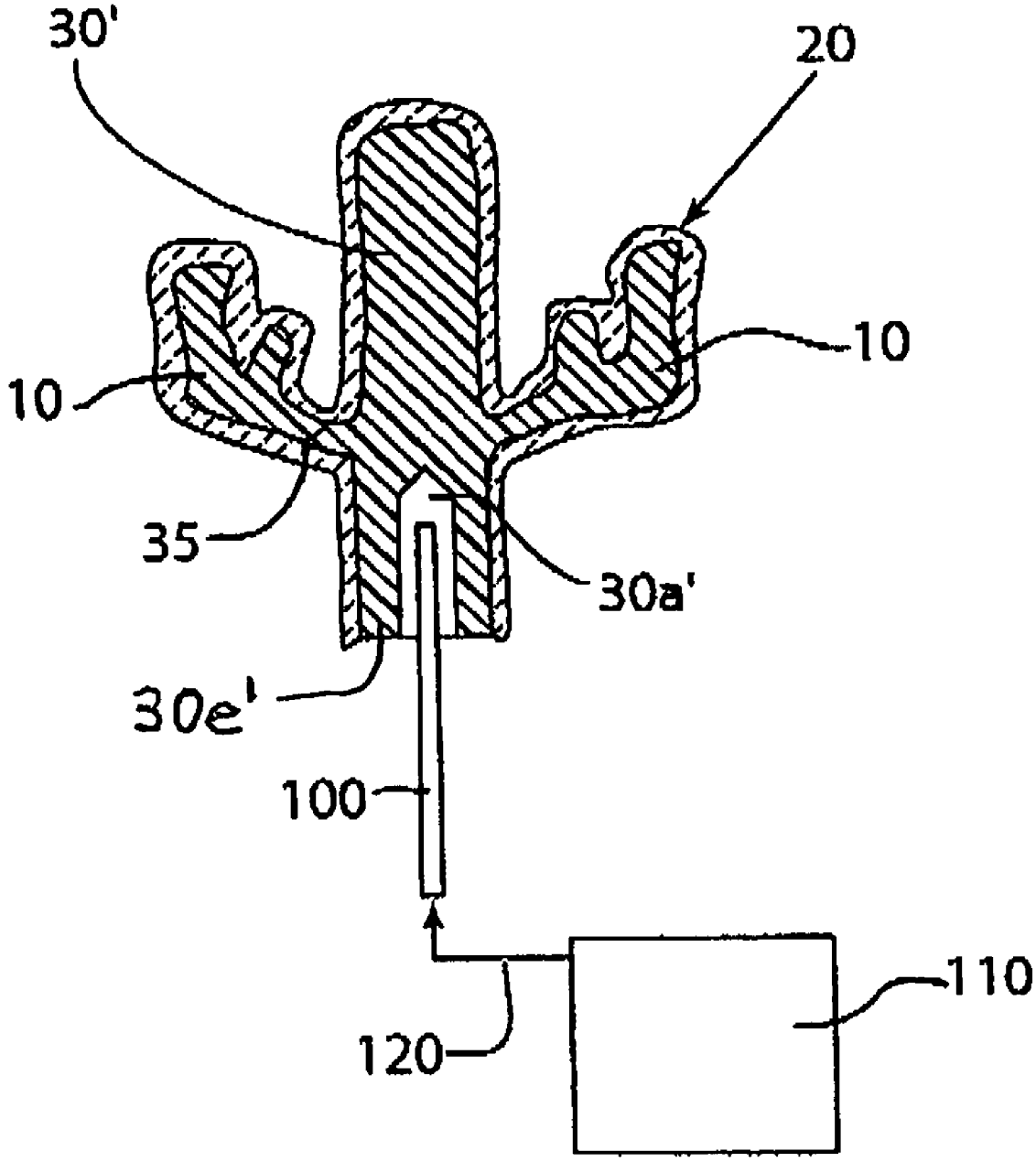
FIG. 5 is similar to FIG. 1 but shows a pattern assembly having a solid sprue with the steam discharge tube being moved into the solid sprue to form in-situ a hollow sprue therein.

Although the chamber 30*a* of the hollow sprue 30 is described above as being preformed in connection with FIGS. 1–4, the invention is not so limited. In particularly, referring to FIG. 5, a chamber 30*a*' can be formed in-situ in a solid wax precursor sprue 30' of the pattern assembly, FIG. 5, by relatively axially moving the steam discharge tube 100 such that the steam discharged at atmospheric pressure from the tube 100 impinges against the exposed end 30*e*' of the solid sprue 30' and progressively melts out the chamber 30*a*' in-situ in the solid precursor sprue 30'. After the chamber 30*a*' is formed, the removal of the now hollow sprue 30' and the patterns 10 can be carried out as described above in connection with FIGS. 1–4. In FIG. 5, like reference numerals are used for like features of FIGS. 1–4.

In another embodiment of the invention illustrated in FIG. 6, a fugitive pattern assembly 40 is removed from a thin wall or other refractory mold 20 that is exteriorly supported or surrounded by a particulate support media 50 in a casting container 60 as described in U.S. Pat. No. 5,069,271. The particulate media 50 can comprise ceramic particles or grog as described in the patent. Pattern removal is effected by discharging steam at substantially atmospheric pressure from the steam discharge tube 100 inside the hollow sprue 30 of the pattern assembly 40 to contact and melt the hollow sprue 30 and then the patterns 10 as described in connection with FIGS. 1–4. The exterior surface 20*s* of the mold 20 contacts the particulate media 50 and is subjected to substantially ambient atmospheric pressure via a vent-to-atmosphere 61 on the casting container 60 during pattern removal. The exterior mold surface 20*s* and the particulates media 50 remain dry (devoid of liquid water) as a result of the melted wax soaking partially into the mold wall W as described above with respect to FIGS. 1–4 and preventing steam condensate from soaking through the mold wall thickness.

For purposes of further illustration and not limitation, another method embodiment of the present invention shown in FIG. 7 will be described below wherein superatmospheric or subatmospheric pressure steam is discharged inside the mold to remove the pattern assembly 240 having a plurality of wax patterns 210 attached by respective gate 235 to central hollow sprue 230 from inside of "lost wax" investment casting shell mold 220. Use of superatmospheric pressure steam while the exterior of the mold is subjected to non-condensing gas at substantially the same superatmospheric pressure permits an increase in the heat capacity per unit volume of the steam as well as enables the melting of higher melt point pattern materials. Use of subatmospheric pressure steam while the exterior of the mold is subjected to non-condensing gas at substantially the same subatmospheric pressure enables melting and removal of pattern materials that, for example, require lower temperatures. The following method embodiment will be described using superatmospheric pressure steam, although the method embodiment may also alternatively use subatmospheric pressure steam instead.

The mold 220 is disposed inside of a pressure vessel 250 over a collection basin 252 to collect and contain melted wax and steam condensate exiting from the mold during the pattern removal operation. The pressure vessel 250 may comprise a casting container of the type that includes particulate support media about the mold 220 as illustrated in FIG. 6. Alternately, the pressure vessel 250 may be devoid of the particulate support media; i.e. empty with only the shell mold therein. The pressure vessel 250 can be formed by a suitable pressure resistant material such as steel and configured as a typical conventional pressure vessel. A casting chamber 60 and mold contained therein as shown in FIG. 6 can also be placed inside a separate pressure vessel 250 for superatmospheric pressure de-waxing.

A seal 254 is provided between the mold 220 and the pressure vessel wall 250*a* to substantially prevent mixing of gas from the region interior of the seal 254 to the exterior of the seal 254. The seal 254 can comprise a steel tubular member having a rubber or other type seal 254*a* for sealing to the mold 220.

Steam at superatmospheric pressure is discharged inside the mold 220 by a steam discharge tube 300 connected to a source S of the superatmospheric pressure steam, such as the previously described steam generator and extending through an opening in wall 250*a*. Simultaneously to the discharge of the superatmospheric pressure steam inside the mold 220, air pressure at substantially the same pressure as the steam pressure inside the mold is provided in the pressure vessel 250 via an inlet 255. The inlet 255 for the superatmospheric air pressure is connected to a source of compressed air, such as an air compressor; for example, Kaeser model SP25 compressor. This method embodiment thus involves discharging steam inside the mold 220 to contact and melt the pattern material while the exterior of the mold 220 is subjected to a steam-free gas atmosphere outside of the mold wherein the steam inside the mold and the steam-free atmosphere outside of the mold are at substantially the same pressure. The steam and corresponding air (or other gas) pressure may be adjusted to any pressure (and therefore temperature) appropriate for the rapid melting of the pattern material.

The superatmospheric pressure inside the pressure vessel can be provided by a gas other than air such as, for example, nitrogen, inert gas, or other gas at the desired superatmospheric pressure substantially equal to that of the steam inside the mold.

An air bleed valve 256 is provided on the pressure vessel wall 250 so as to reside in the region inside the seal 254 to bleed the air that was initially inside the mold 220 from the region inside the seal 254.

Figure 7:
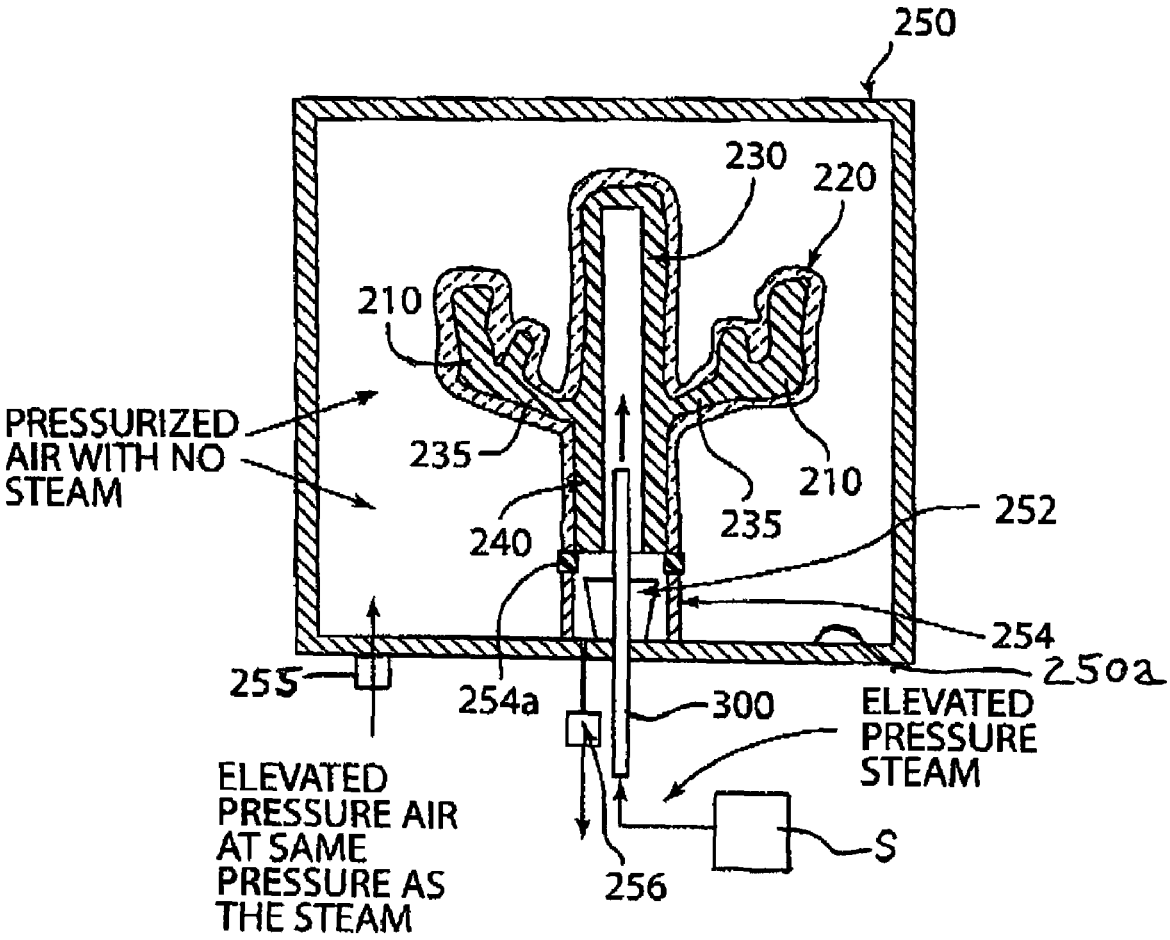
FIG. 7 is similar to FIG. 1 and shows a refractory investment casting shell mold having fugitive patterns to be removed pursuant to another embodiment of the invention by discharging steam at superatmospheric or subatmospheric pressure from a steam discharge tube shown positioned inside a hollow sprue of a pattern assembly residing inside the mold.

The pattern removal operation of the embodiment of FIG. 7 proceeds as described above with respect to steam discharged atmospheric pressure inside the mold 20 wherein the superatmospheric steam contacts the solid wax material of the pattern assembly and condenses. More heat is delivered to the wax surface in this embodiment of the invention since the superatmospheric steam is at a higher temperature when compressed. A slightly reduced pressure is formed at the wax surface when the steam condenses, which draws more steam into contact with the wax surface to facilitate the pattern removal operation. Molten wax from the wax surface and steam condensate flows out of the mold cavity and into the wax and condensate collection basin 252. De-waxing action occurs only internally in the mold 220 in an orderly manner from the sprue 230 to the gate 235 and then into the wax patterns 210. The mold-to-pressure vessel seal 254*a* results in no steam being applied to the exterior of the mold 220 in the pressure vessel 250. A steam-free atmosphere is thereby provided in the pressure vessel 250.

The invention is advantageous to remove one or more fugitive patterns from a metal casting refractory mold, which may have any mold wall thickness and which may be unsupported or supported by exterior particulate media therearound. The invention is further advantageous to remove one or more fugitive patterns while avoiding saturating the mold wall with steam condensate. The invention may be practiced to reduce mold cracking during pattern removal and to allow the use of thin-walled molds without mold cracking.

Those skilled in the art will appreciate that the invention is not limited to the embodiments described above and that changes and modifications can be made therein within the spirit of the invention as set forth in the appended claims.

We claim:

1. A method of removing a fugitive pattern from inside a refractory mold, comprising discharging condensable vapor inside the mold to contact and melt the pattern material while an exterior of the mold is subjected to a non-condensing gas atmosphere outside of the mold, condensing said condensable vapor inside the mold where it contacts and melts the pattern while the exterior of the mold remains free of condensed vapor, and draining the melted pattern material and condensed vapor out of the mold.

2. The method of claim 1 wherein a pressure differential between the condensable vapor inside the mold and the non-condensing gas atmosphere outside of the mold is small enough as to prevent the condensable gas from exiting outside the mold exterior and the non-condensing gas from entering a mold cavity in the mold.

3. The method of claim 2 wherein the condensable gas and the non-condensing gas atmosphere are at substantially the same pressure.

4. The method of claim 1 wherein the condensable vapor comprise steam.

5. The method of claim 1 wherein the non-condensing gas is air.

6. The method of claim 1 wherein the condensable vapor is supplied from a source to a discharge tube from which it is discharged inside the mold.

7. The method of claim 1 wherein the condensable vapor is discharged inside the mold at atmospheric pressure.

8. The method of claim 1 wherein the condensable vapor is discharged inside the mold at superatmospheric or subatmospheric pressure and a non-condensing gas at substantially the same superatmospheric or subatmospheric pressure is provided exterior of the mold in a vessel containing the mold.

9. The method of claim 8 including preventing the condensable vapor from entering the vessel exterior of the mold using a seal between the mold and the vessel.

10. The method of claim 1 wherein the fugitive pattern comprises wax.

11. The method of claim 1 wherein an axis of the mold containing the fugitive pattern is tilted with respect to the direction of gravity during the melting of the fugitive pattern or after the fugitive pattern has been melted.

12. The method of claim 1 including initially discharging the condensable vapor inside a hollow sprue of the pattern.

13. The method of claim 12 wherein the hollow sprue is preformed in the fugitive pattern prior to the discharging of the condensable vapor.

14. The method of claim 12 wherein the hollow sprue is formed by condensable vapor discharged against an exposed end of the solid sprue.

15. The method of claim 14 wherein a condensable vapor discharge tube and the pattern residing in the mold are relatively moved to form the hollow sprue.

16. The method of claim 15 wherein the discharge tube is moved.

17. The method of claim 1 wherein the exterior of the mold is surrounded by a support particulate media in a container.

18. The method of claim 1 wherein the exterior of the mold is not surrounded by a support particulate media.

19. A method of removing a fugitive pattern from a refractory mold residing in a particulate media, comprising discharging condensable vapor inside the mold to contact and melt the pattern material while an exterior of the mold contacts the particulate media which is subjected to a non-condensing gas atmosphere outside of the mold wherein said condensable vapor inside the mold and said atmosphere outside of the mold are at substantially the same pressure, condensing said condensable vapor inside the mold where it contacts and melts the pattern while the exterior of the mold and the particulate media remain free of condensed vapor, and draining the melted pattern material and condensed vapor out of the mold.

20. The method of claim 19 wherein the condensable vapor comprise steam.

21. The method of claim 19 wherein the non-condensing gas is air.

22. The method of claim 19 wherein the condensable vapor is supplied from a source to a discharge tube from which it is discharged into the mold.

23. The method of claim 19 wherein the condensable vapor is discharged inside the mold at atmospheric pressure.

24. The method of claim 19 wherein the condensable vapor steam is discharged inside the mold at superatmospheric or subatmospheric pressure and a non-condensing gas at substantially the same superatmospheric or subatmospheric pressure is provided exterior of the mold in a vessel containing the mold.

25. The method of claim 24 including preventing the condensable vapor from entering the vessel using a seal between the mold and the vessel.

26. The method of claim 19 wherein the fugitive pattern comprises wax.

27. The method of claim 19 wherein an axis of the mold containing the fugitive pattern is tilted with respect to the direction of gravity during the melting of the fugitive pattern or after the fugitive pattern has been melted.

28. The method of claim 19 including discharging the condensable vapor inside a hollow sprue of the pattern.

29. The method of claim 28 wherein the hollow sprue is preformed in the fugitive pattern prior to the discharging of the condensable vapor.

30. The method of claim 28 wherein the hollow sprue is formed by condensable vapor discharged against an exposed end of the solid sprue.

31. The method of claim 30 wherein a condensable vapor discharge tube and the pattern residing in the mold are relatively moved to form the hollow sprue.

32. A method of removing a fugitive pattern connected to a hollow fugitive sprue from inside of a gas permeable refractory mold, comprising discharging condensable vapor inside the hollow sprue of the pattern to melt fugitive material of the sprue and then inside the mold to melt the fugitive material of the pattern while an exterior of the mold is subjected to a non-condensing gas atmosphere outside of the mold wherein said condensable vapor inside the mold and said atmosphere outside of the mold are at substantially the same pressure, condensing said condensable vapor inside the mold where it contacts the fugitive material while the exterior of the mold remains free of condensed vapor, and draining the melted fugitive material and condensed vapor out of the mold.

33. The method of claim 32 wherein the condensable vapor comprise steam.

34. The method of claim 32 wherein the non-condensing gas is air.

35. The method of claim 32 wherein the hollow sprue is preformed in the fugitive pattern prior to the discharging of the condensable vapor.

36. The method of claim 32 wherein the hollow sprue is formed by condensable vapor discharged against an exposed end of the solid fugitive sprue.

37. The method of claim 36 wherein a condensable vapor discharge tube and the pattern residing in the mold are relatively moved to form the hollow sprue.

* * * * *